US011686120B1

(12) United States Patent
Yates

(10) Patent No.: US 11,686,120 B1
(45) Date of Patent: Jun. 27, 2023

(54) SHADING ASSEMBLY

(71) Applicant: Gary Lee Yates, Austin, TX (US)

(72) Inventor: Gary Lee Yates, Austin, TX (US)

( * ) Notice: Subject to any disclaimer, the term of this patent is extended or adjusted under 35 U.S.C. 154(b) by 0 days.

(21) Appl. No.: 17/501,765

(22) Filed: Oct. 14, 2021

(51) Int. Cl.
*E04H 15/44* (2006.01)

(52) U.S. Cl.
CPC ..... *E04H 15/44* (2013.01)

(58) Field of Classification Search
CPC ..... E04H 15/005; E04H 15/44; E04H 15/58; E04H 15/32
See application file for complete search history.

(56) References Cited

U.S. PATENT DOCUMENTS 2,660,186 A * 11/1953 Marshall ..... E04H 15/003 135/153
3,070,107 A * 12/1962 Beatty ..... E04H 15/003 D30/118
3,075,536 A * 1/1963 George ..... E04H 15/003 D21/837
4,056,327 A * 11/1977 Daus, Jr. ..... E04H 15/32 403/172
5,080,123 A * 1/1992 Stein ..... E04H 15/003 135/900
7,406,977 B1 * 8/2008 Shires ..... E04H 15/26 135/121
9,051,756 B1 * 6/2015 Jenkins ..... E04H 15/58
9,903,134 B2 * 2/2018 Munnerlyn ..... E04H 15/001
2003/0089390 A1 * 5/2003 Seo ..... E04H 15/60 135/120.4
2010/0212709 A1 * 8/2010 Sotirkys ..... E04H 15/06 135/88.01
2012/0291830 A1 * 11/2012 Crimi ..... E04H 15/58 135/117
2014/0041703 A1 * 2/2014 Funston ..... E04H 15/54 135/121

* cited by examiner

*Primary Examiner* — Noah Chandler Hawk
(74) *Attorney, Agent, or Firm* — Plager Schack LLP; Mark H. Plager; Michael J. O'Brien

(57) ABSTRACT

A shading assembly is configured to provide a shaded area to a user. The shading assembly has a three-point connector locking system with a lower bracket having a first cord opening, a second cord opening, and a pin opening. A first horizontal pole is fit inside the three-point connector pole having a first horizontal pole first section joined a first horizontal pole second section with a first horizontal pole bungee section. A vertical pole is fit inside the three-point connector and having a first vertical pole section joined to a second vertical pole section with a vertical pole bungee. A shade having a first shade pocket arranged around the first horizontal pole and a second shade pocket arranged around the second horizontal pole. Wind blows the shade away from the shade pocket creating a shaded area for the user.

7 Claims, 4 Drawing Sheets

SHADING ASSEMBLY

RELATED APPLICATION

This application claims priority to provisional patent application U.S. Ser. No. 63/941,761 filed on Oct. 14, 2020, the entire contents of which is herein incorporated by reference.

BACKGROUND

The embodiments herein relate generally to outdoor equipment.

Prior to embodiments of the disclosed invention conventional metal framed tents and shades were bulky, heavy, broke down from corrosion, could not withstand high winds, and were not wind driven in design. Embodiments of the disclosed invention solve these problems.

SUMMARY

A shading assembly is configured to provide a shaded area to a user. The shading assembly further comprises a three-point connector locking system. The three-point connector locking system further comprises a lower bracket having a first cord opening, a second cord opening, and a pin opening. A first horizontal pole fits inside the three-point connector pole. The first horizontal pole further comprises a first horizontal pole first section joined a first horizontal pole second section with a first horizontal pole bungee section.

A second horizontal pole is fit inside the three-point connector. The second horizontal pole further comprises a second horizontal pole first section joined a second horizontal pole second section with a second horizontal pole bungee section.

A vertical pole fits inside the three-point connector. The vertical pole further comprises a first vertical pole section joined to a second vertical pole section with a vertical pole bungee.

A shade further comprises a first shade pocket arranged around the first horizontal pole and a second shade pocket arranged around the second horizontal pole. Wind blows the shade away from the shade pocket creating a shaded area for the user.

In some embodiments, the shading assembly further comprises a first cord. The first cord is arranged through the first cord opening and joined to a first sandbag adjacent to a ground surface. A second cord is arranged through the second cord opening and joined to a second sandbag adjacent to a ground surface.

In some embodiments, the vertical pole is secured with a locking pin through the pin opening. In some embodiments, the first shade pocket and the second shade pocket are proximate but not touching the three-point connector locking system.

A shading assembly can be configured to provide a shaded area to a user. The shading assembly comprises a first two-point connector locking system. The first two-point connector locking system further comprising a first lower bracket having a first cord opening and a first pin opening. A second two-point connector locking system further comprises a lower bracket having a first cord opening and a second pin opening.

A horizontal pole fits inside the first two-point connector locking system and the second two-point connector locking system. A first vertical pole further comprises a first vertical pole first section joined to a first vertical pole second section with a first vertical pole bungee section. A second vertical pole further comprises a second vertical pole first section joined to a second vertical pole second section with a second vertical pole bungee section.

A shade further comprises a shade pocket arranged around the horizontal pole. Wind blows the shade away from the shade pocket creating a shaded area for the user.

In some embodiments, a first cord is arranged through the first cord opening and joined to a sandbag adjacent to a ground surface. A second cord can be arranged through the second cord opening and joined the sandbag adjacent.

The first vertical pole can be secured with a first locking pin through the first pin opening. The second vertical pole can be secured with a second locking pin through the second pin opening.

In some embodiments, a first horizontal locking pin can be arranged through the horizontal pole and the first two-point connector. A second horizontal locking pin can be arranged through the horizontal pole and the second two-point connector.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
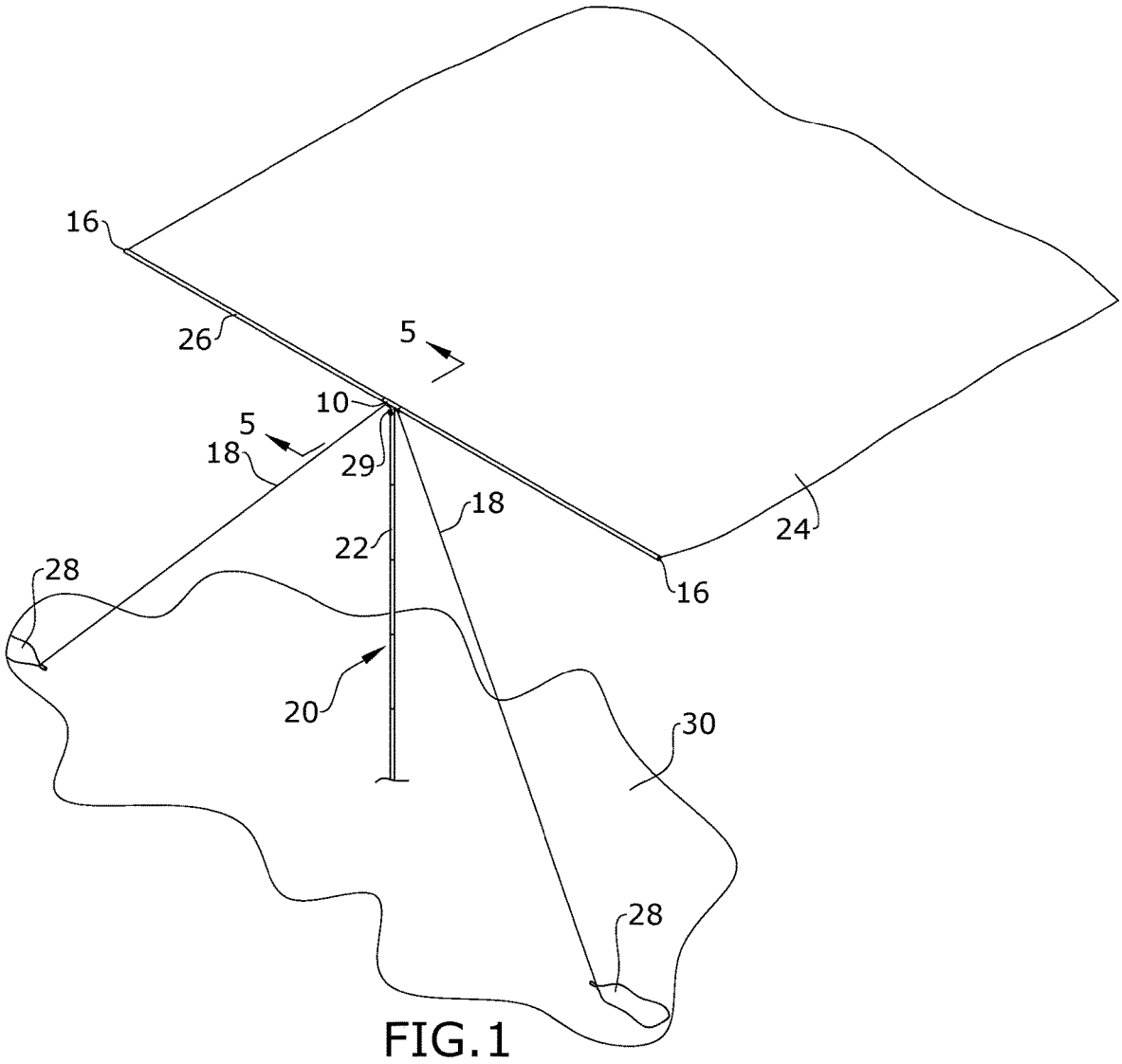
FIG. 1 shows a perspective view of one embodiment of the present invention.
Figure 2:
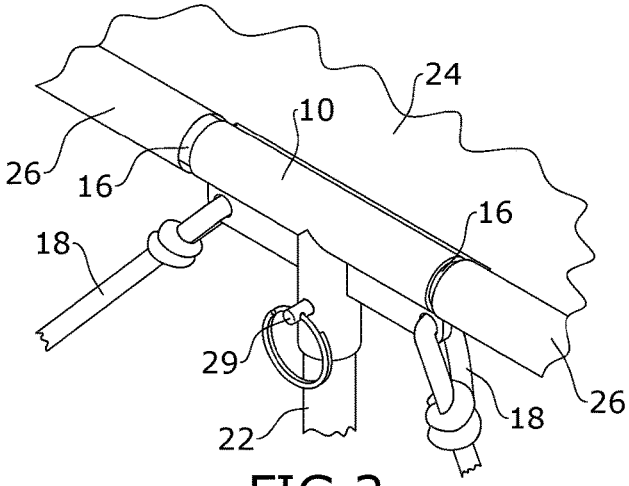
FIG. 2 shows a detailed perspective view of one embodiment of the present invention.
Figure 3:
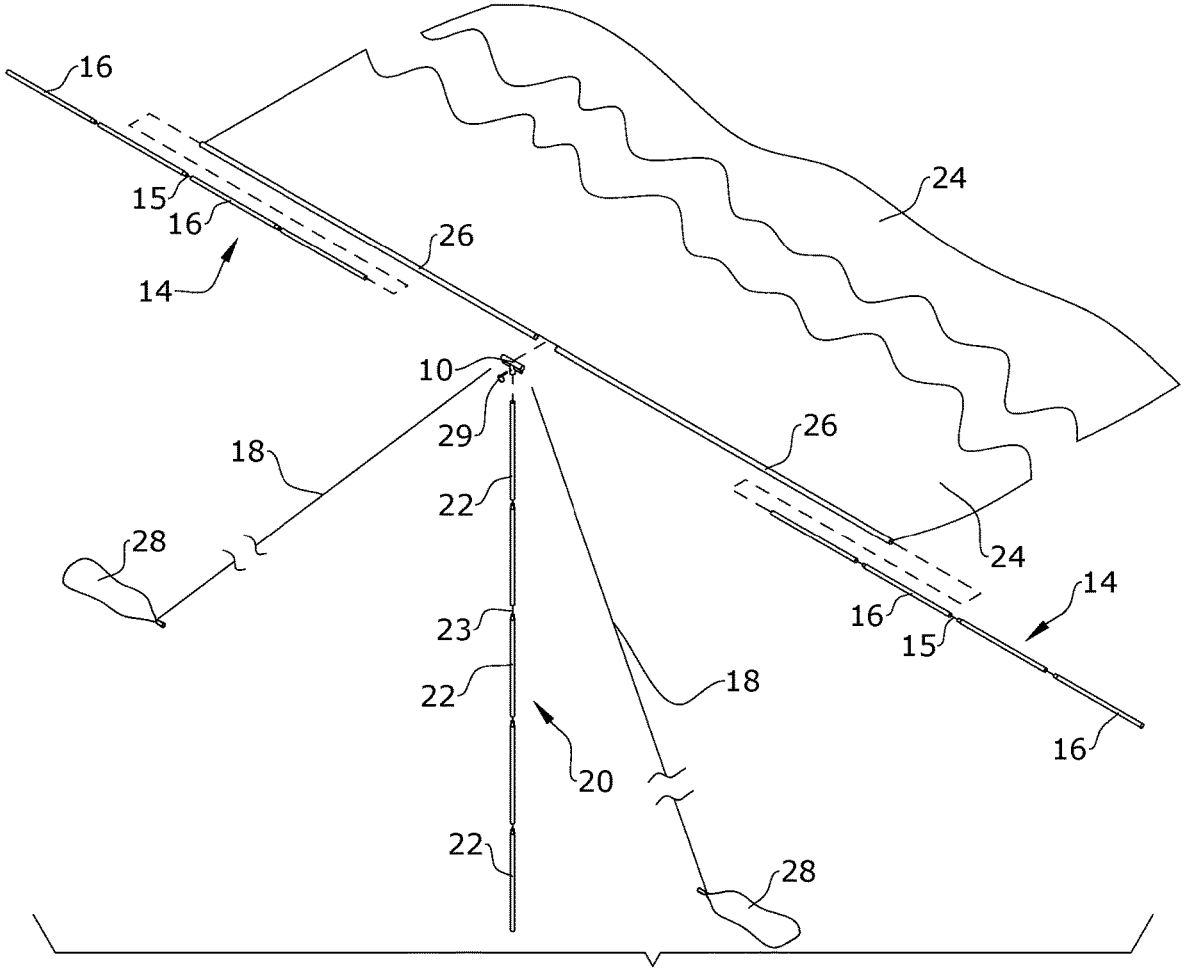
FIG. 3 shows an exploded view of one embodiment of the present invention.
Figure 4:
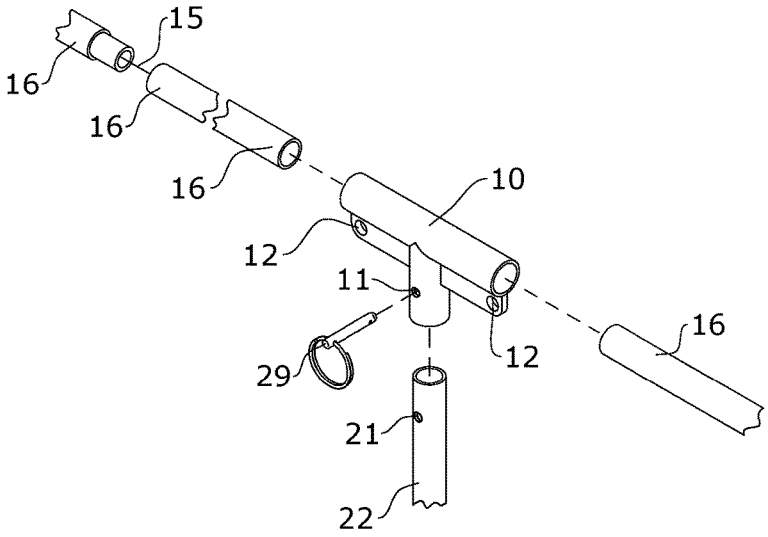
FIG. 4 shows a detailed exploded view of one embodiment of the present invention.
Figure 5:
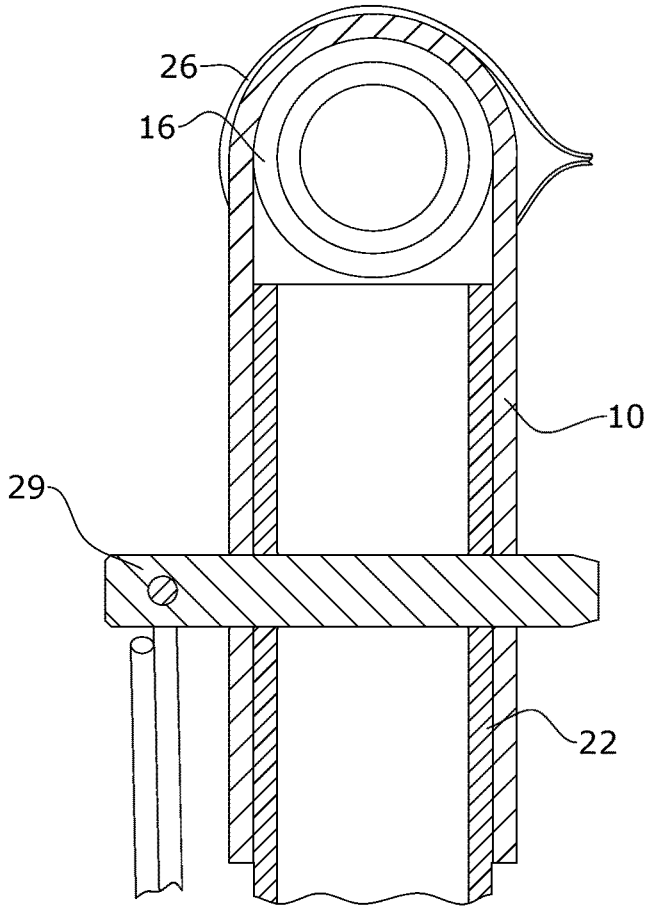
FIG. 5 shows a section view of one embodiment of the present invention taken along line 5-5 in FIG. 1.
Figure 6:
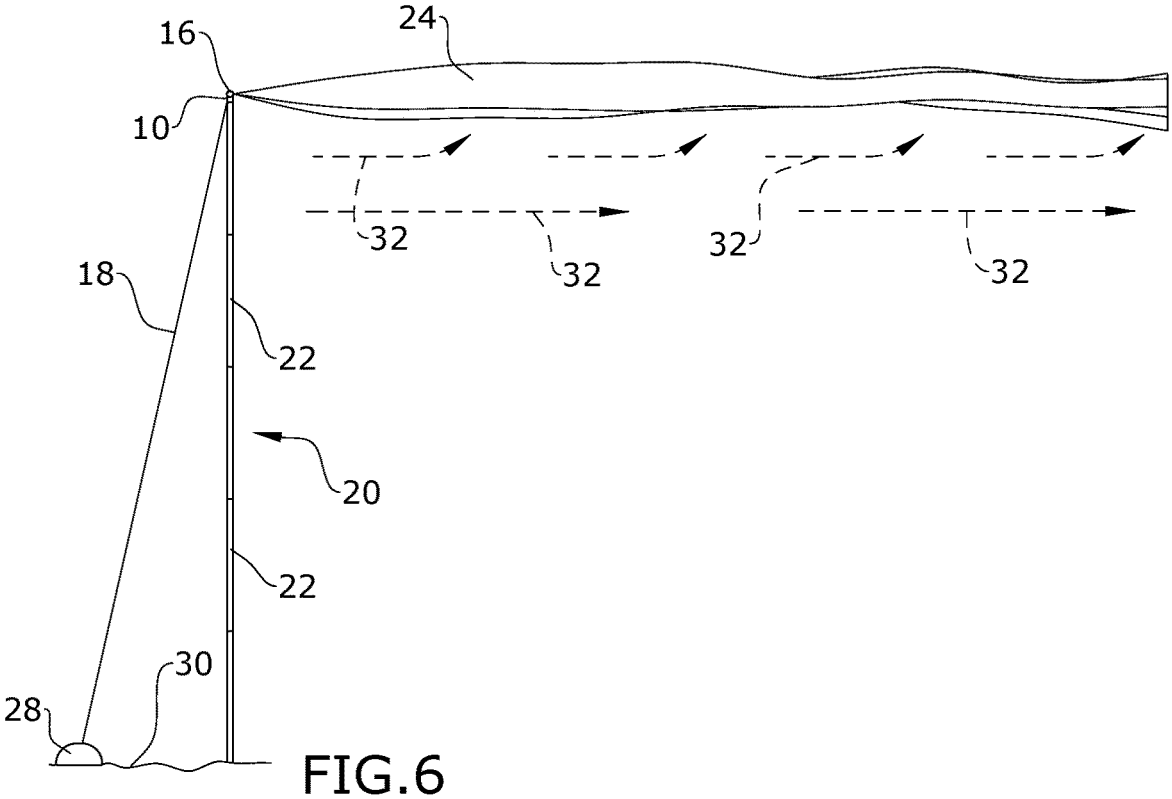
FIG. 6 shows a side view of one embodiment of the present invention taken along line 5-5 in FIG. 1.

By way of example, and referring to FIG. 1, one embodiment of a shading assembly is configured to provide a shaded area to a user. The shading assembly further comprises a three-point connector locking system 10. The three-point connector locking system 10 further comprises a lower bracket having a first cord opening 12, a second cord opening 12, and a pin opening 11. A first horizontal pole 16 fits inside the three-point connector locking system 10. The first horizontal pole 16 further comprises a first horizontal pole first section joined a first horizontal pole second section with a first horizontal pole bungee section 15.

A second horizontal pole 16 is fit inside the three-point connector locking system 10. The second horizontal pole 16 further comprises a second horizontal pole first section joined a second horizontal pole second section with a second horizontal pole bungee section 15.

A vertical pole 20 fits inside the three-point connector. The vertical pole 20 further comprises a first vertical pole section 22 joined to a second vertical pole section 22 with a vertical pole bungee 23.

A shade 24 further comprises a first shade pocket 26 arranged around the first horizontal pole 16 and a second shade pocket 26 arranged around the second horizontal pole 16. Wind blows the shade 24 away from the shade pocket 26 creating a shaded area for the user.

In some embodiments, the shading assembly further comprises a first cord 18. The first cord 18 is arranged through the first cord opening and joined to a first sandbag 28 that is adjacent to a ground surface 30. A second cord 18 is arranged through the second cord opening and joined to a second sandbag 28 adjacent to the ground surface 30.

In some embodiments, the vertical pole 20 is secured with a locking pin 29 through the pin opening 21. In some embodiments, the first shade pocket 26 and the second shade pocket 26 are proximate but not touching the three-point connector locking system 10.

Figure 7:
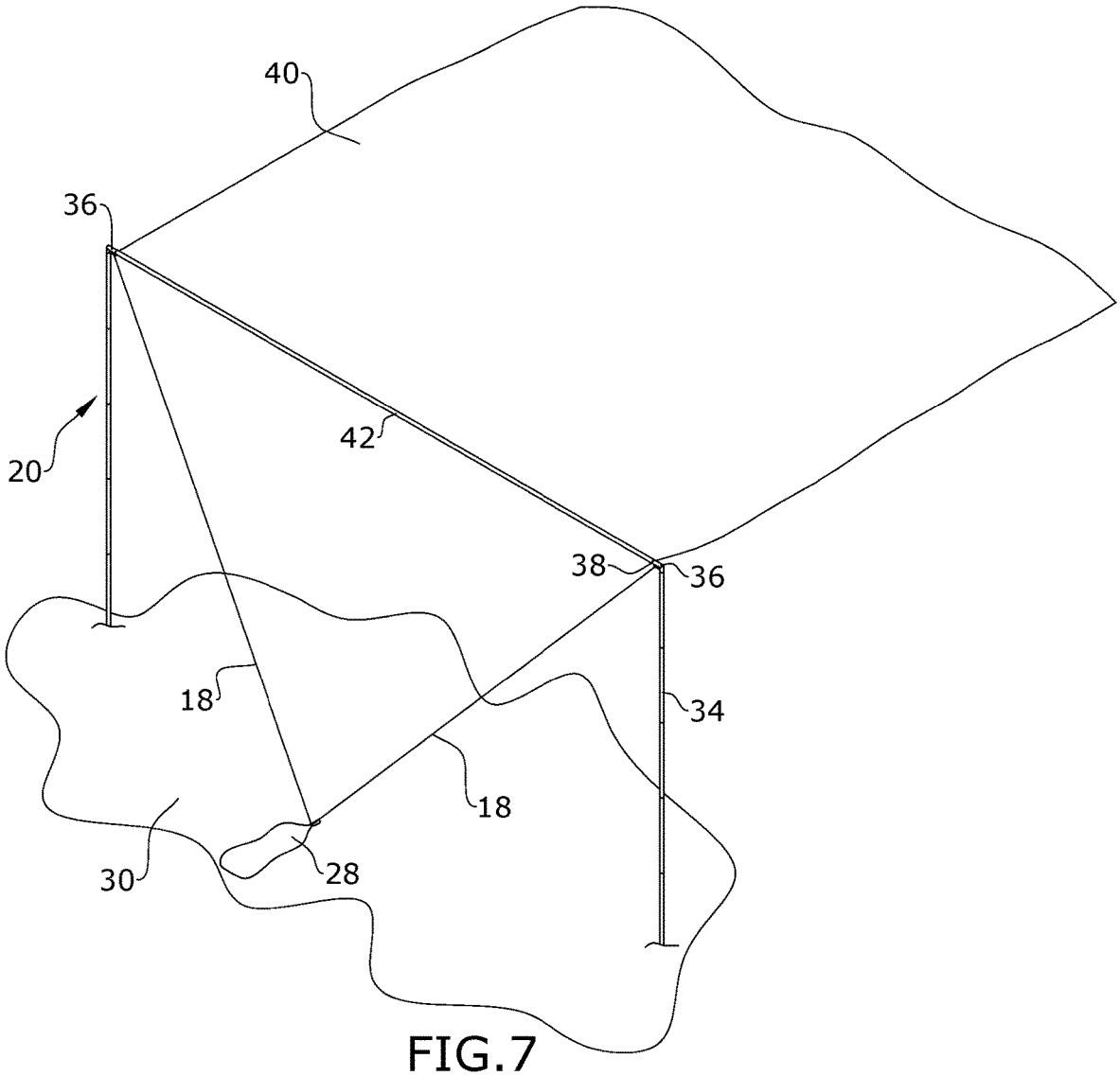
FIG. 7 shows a perspective view of one embodiment of the present invention.
Figure 8:
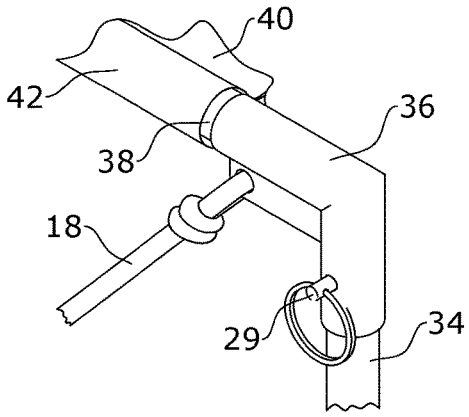
FIG. 8 shows a detailed perspective view of one embodiment of the present invention.

Turning to FIGS. 7-8, a shading assembly can be configured to provide a shaded area to a user. The shading assembly comprises a first two-point connector locking system 36. The first two-point connector locking system 36 further comprising a first lower bracket having a first cord opening and a first pin opening. A second two-point connector locking system 36 further comprises a second lower bracket having a first cord opening and a second pin opening.

A horizontal pole 38 fits inside the first two-point connector locking system 36 and the second two-point connector locking system 36. A first vertical pole 20 further comprises a first vertical pole first section joined to a first vertical pole second section with a first vertical pole bungee section. A second vertical pole 34 further comprises a second vertical pole first section joined to a second vertical pole second section with a second vertical pole bungee section.

A shade 40 further comprises a shade pocket 42 arranged around the horizontal pole 38. Wind blows the shade 40 away from the shade pocket 42 creating a shaded area for the user.

In some embodiments, a first cord 18 is arranged through the first cord opening and joined to a sandbag 28 adjacent to a ground surface 30. A second cord 18 can be arranged through the second cord opening and joined the sandbag 28 adjacent to the ground surface 30.

The first vertical pole 20 can be secured with a first locking pin 29 through the first pin opening. The second vertical pole 34 can be secured with a second locking pin 29 through the second pin opening.

In some embodiments, a first horizontal locking pin can be arranged through the horizontal pole and the first two-point connector. A second horizontal locking pin can be arranged through the horizontal pole and the second two-point connector.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A shading assembly, configured to provide a shaded area to a user; the shading assembly further comprising:

a three-point connector locking system, further comprising a lower bracket having a first cord opening, a second cord opening, and a pin opening;

a first horizontal pole, fit inside the three-point connector pole further comprising a first horizontal pole first section joined to a first horizontal pole second section with a first horizontal pole bungee section;

a second horizontal pole, fit inside the three-point connector and further comprising a second horizontal pole first section joined to a second horizontal pole second section with a second horizontal pole bungee section;

a vertical pole, fit inside the three-point connector and further comprising a first vertical pole section joined to a second vertical pole section with a vertical pole bungee;

a shade further comprising a first shade pocket arranged around the first horizontal pole and a second shade pocket arranged around the second horizontal pole;

wherein wind blows the shade away from the shade pocket creating a shaded area for the user.

2. The shading assembly of claim 1, further comprising:

a first cord, arranged through the first cord opening and joined to a first sandbag adjacent to a ground surface; and a second cord, arranged through the second cord opening and joined to a second sandbag adjacent to a ground surface.

3. The shading assembly of claim 2, wherein and the vertical pole is secured with a locking pin through the pin opening.

4. The shading assembly of claim 2, wherein the first shade pocket and the second shade pocket are proximate but not touching the three-point connector locking system.

5. A shading assembly, configured to provide a shaded area to a user; the shading assembly further comprising:

a first two-point connector locking system, further comprising a first lower bracket having a first cord opening and a first pin opening;

a second two-point connector locking system, further comprising a lower bracket having a first cord opening and a second pin opening;

a horizontal pole, fit inside the first two-point connector locking system and the second two-point connector locking system;

a first vertical pole further comprising a first vertical pole first section joined to a first vertical pole second section with a first vertical pole bungee section;

a second vertical pole further comprising a second vertical pole first section joined to a second vertical pole second section with a second vertical pole bungee section;

a shade further comprising a shade pocket arranged around the horizontal pole;

a first cord, arranged through the first cord opening and joined to a sandbag adjacent to a ground surface;

a second cord, arranged through the second cord opening and joined the sandbag adjacent to the ground surface wherein wind blows the shade away from the shade pocket creating a shaded area for the user.

6. The shading assembly of claim 5, wherein the first vertical pole is secured with a first locking pin through the first pin opening;

wherein the second vertical pole is secured with a second locking pin through the second pin opening.

7. The shading assembly of claim 5, further comprising:

a first horizontal locking pin, arranged through the horizontal pole and the first two-point connector; and a second horizontal locking pin, arranged through the horizontal pole and the second two-point connector.

* * * * *